US006625957B2

(12) United States Patent
Spatafora

(10) Patent No.: US 6,625,957 B2
(45) Date of Patent: Sep. 30, 2003

(54) METHOD AND MACHINE FOR PRODUCING HINGED-LID PACKETS OF CIGARETTES

(75) Inventor: Mario Spatafora, Bologna (IT)

(73) Assignee: G.D Societe' per Azioni, Bologna (IT)

( * ) Notice: Subject to any disclaimer, the term of this patent is extended or adjusted under 35 U.S.C. 154(b) by 101 days.

(21) Appl. No.: 09/829,659

(22) Filed: Apr. 10, 2001

(65) Prior Publication Data

US 2002/0020150 A1 Feb. 21, 2002

(30) Foreign Application Priority Data

Apr. 10, 2000 (IT) ..... BO2000A0209

(51) Int. Cl.[7] ..... B65B 19/20

(52) U.S. Cl. ..... 53/462; 53/466; 53/207; 53/234

(58) Field of Search ..... 53/462, 466, 207, 53/232–234

(56) References Cited

U.S. PATENT DOCUMENTS 4,208,854 A * 6/1980 Seragnoli ..... 53/207
4,596,112 A * 6/1986 Buckley et al. ..... 53/207

FOREIGN PATENT DOCUMENTS

DE DE 3536791 A 4/1987

* cited by examiner

*Primary Examiner*—Stephen F. Gerrity
(74) *Attorney, Agent, or Firm*—Marshall, Gerstein & Borun LLP

(57) ABSTRACT

A method of producing hinged-lid packets of cigarettes on a continuous automatic machine, whereby a blank is closed about a group of cigarettes, the blank having a longitudinal axis, a rear panel, first tabs connected to the rear panel, and second and third tabs connected to the first tabs; the method providing for feeding the blank continuously along a given path with the axis of the blank crosswise to the path; and folding the first tabs with respect to the rear panel so that the second and third tabs are so positioned as to be intercepted by fixed folding devices located along the path.

24 Claims, 4 Drawing Sheets

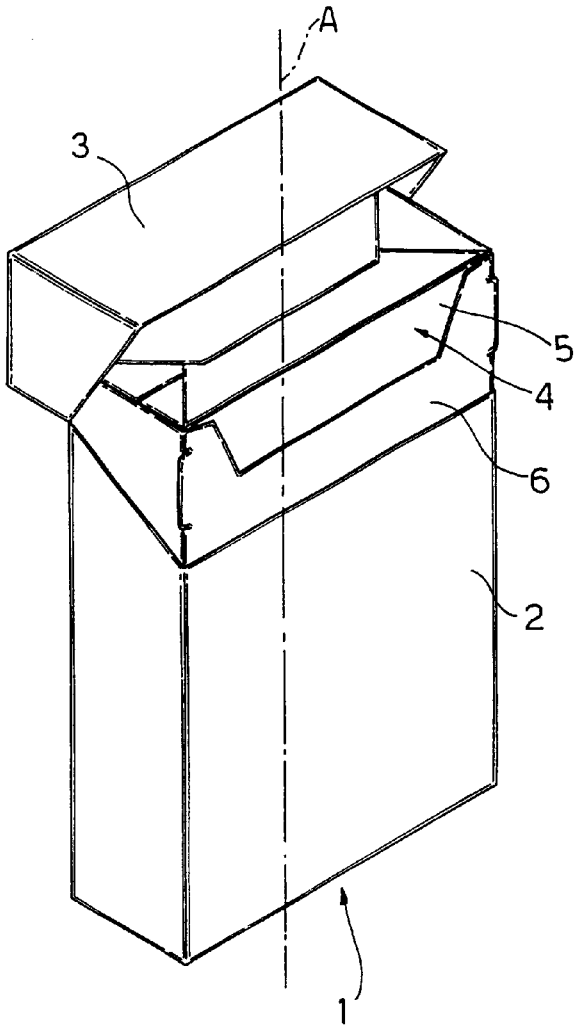
Fig. 1
Fig. 6
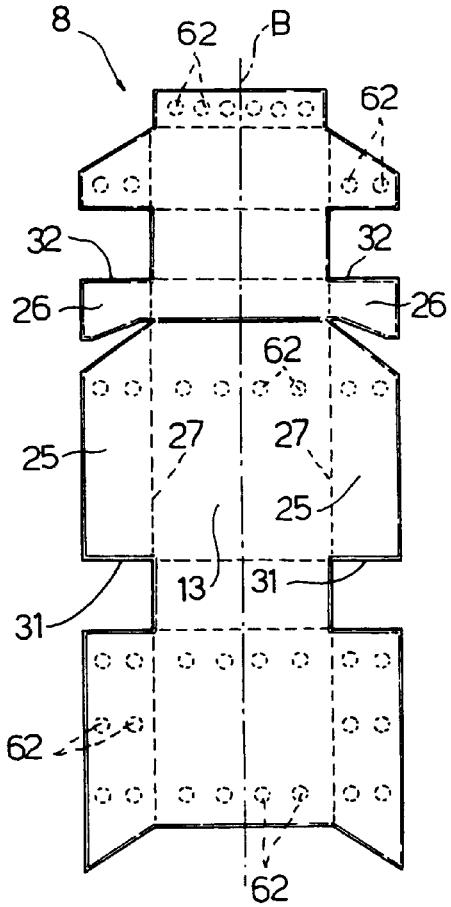
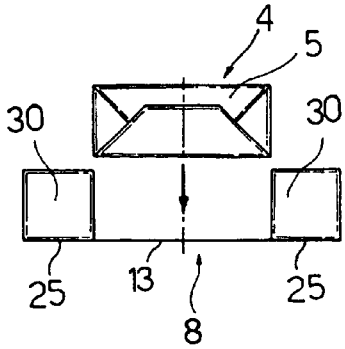
Fig. 7

METHOD AND MACHINE FOR PRODUCING HINGED-LID PACKETS OF CIGARETTES

The present invention relates to a method of producing hinged-lid packets of cigarettes.

BACKGROUND OF THE INVENTION

Hinged-lid packets of cigarettes are normally produced on automatic machines comprising step conveyors and implementing various methods, all of which are based on two opposite principles: a first, whereby a group of cigarettes and a flat blank are brought together, and the blank is folded about the group of cigarettes to enclose the group inside the blank; and a second, whereby the blank is folded to form a pocket, the group is inserted into the pocket, and further folds are made to enclose the group of cigarettes inside the blank.

Methods based on the second principle have been widely used in the past, and have the advantage of speeding up the production of packets of cigarettes by permitting parallel performance of separate operations on the blanks and groups before the two are brought together, so that relatively few folds remain to be made once the groups of cigarettes are inserted inside the blanks. Methods based on the second principle, however, call for inserting the group extremely accurately inside the pocket, to avoid damaging the group and/or blank, and, for this reason, have proved unsuitable for use on continuous automatic machines, on which the extremely high speed at which the groups and blanks are brought together does not allow the group and the pocket to be maintained facing each other long enough to ensure correct insertion of the group inside the pocket of the blank.

Methods based on the first principle are undoubtedly more suitable for use on continuous automatic machines, in that any inaccuracy when the group and blank are brought together produces no damage to either, and can be corrected later when folding the blank by means of folding devices. Nevertheless, such methods, when used on continuous automatic machines, also involve drawbacks, by requiring that the machines be equipped with a large number of movable folding devices, which complicate the machine and only operate once the groups of cigarettes and blanks have been brought together.

DE-3536791 discloses an automatic packing machine for the continuous production and filling of hinge-lid packs. In the machine disclosed by DE-3536791, blanks are fed from a plurality of magazines via a continuously running feeder conveyor to a likewise continuously rotating folding conveyor; the already prefolded blanks are introduced directly by the feeder wheel into pockets of a pocket chain and during transport of such pockets, prefabricated cigarette blocks are conveyed to the pockets and the blanks in these by diagonal conveyors; finally, the largely ready-folded hinge-lid packs are ejected from the pockets by accompanying conveyors in the same way.

DE-3536791 discloses a continues packing machine, which partially folds a blank before feeding the relevant cigarette block to such blank; however, the machine disclosed by DE-3536791 results relatively complicated and bulky and, thus, expensive.

SUMMARY OF THE INVENTION

It is an object of the present invention to provide a method of producing hinged-lid packets of cigarettes, designed to eliminate the drawbacks of the known state of the art, and which, in particular, is suitable for use on a continuous automatic machine.

According to the present invention, there is provided a method of producing hinged-lid packets of cigarettes.

The present invention relates to a machine for producing hinged-lid packets of cigarettes.

According to the present invention, there is provided a machine for producing hinged-lid packets of cigarettes.

The present invention also relates to a method of producing hinged-lid packets of cigarettes.

According to the present invention, there is provided a method of producing hinged-lid packets of cigarettes.

BRIEF DESCRIPTION OF THE DRAWINGS

A non-limiting embodiment of the invention will be described by way of example with reference to the accompanying drawings, in which:

FIG. 1 shows a view in perspective of a packet of cigarettes produced using the method according to the present invention;

FIG. 6 shows a plan view of a blank folded partly according to a variation of the method according to the present invention;

FIG. 7 shows a front view of the FIG. 6 blank.

DETAILED DESCRIPTION OF THE INVENTION

Figure 2:
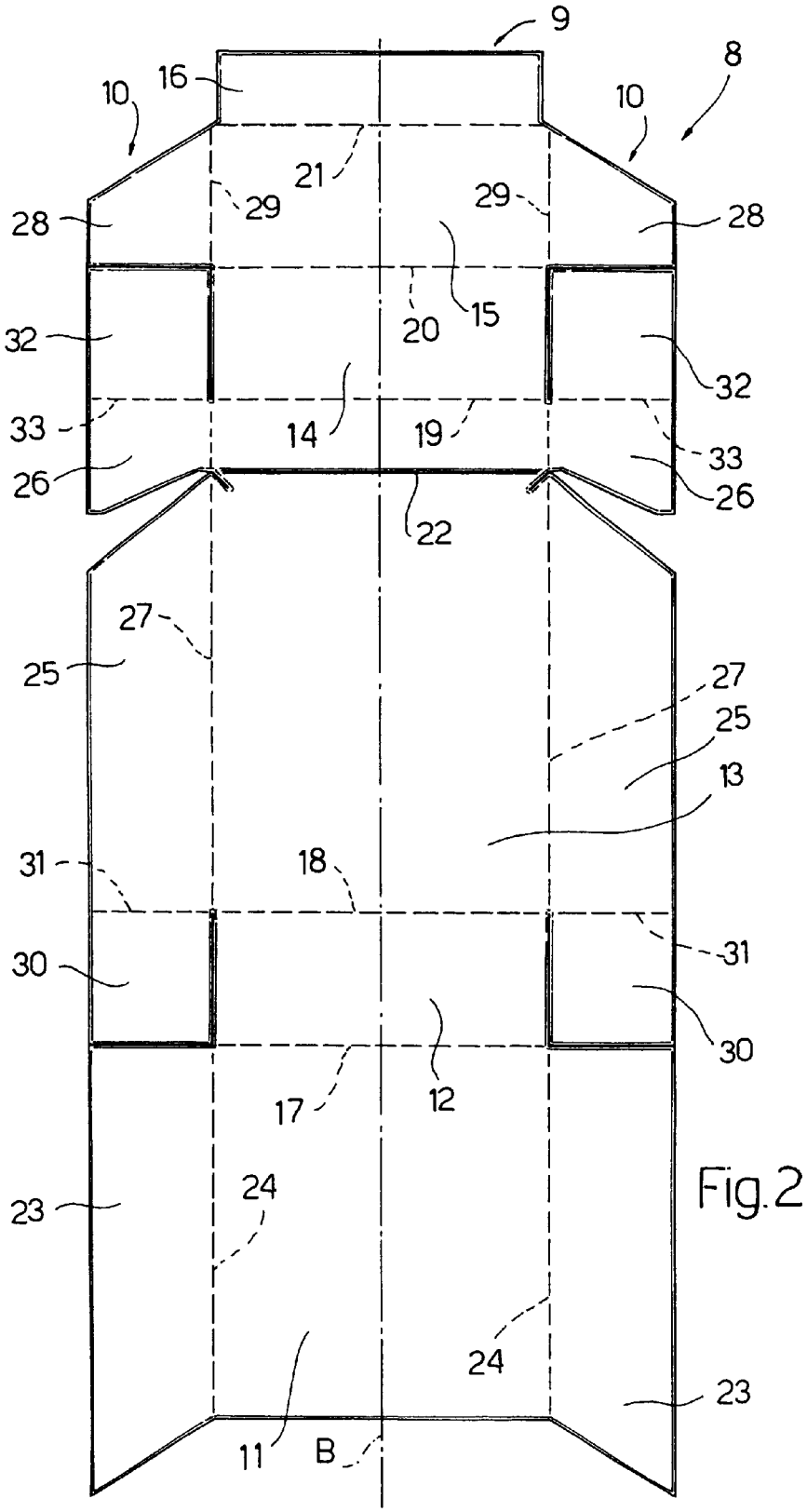
FIG. 2 shows a plan view of a flat blank which may be used to form the FIG. 1 packet.

Number 1 in FIG. 1 indicates a hinged-lid packet in the form of a parallelepiped and having a longitudinal axis A. Packet 1 comprises a cup-shaped body 2; a hinged lid 3 tiltable with respect to cup-shaped body 2; and a group 4 housed inside cup-shaped body 2. Group 4 is defined by a given number of cigarettes (not shown in FIG. 1) wrapped in a sheet 5; and by a collar 6 contacting sheet 5 and projecting partly with respect to cup-shaped body 2. Group 4 is substantially of the same parallelepiped shape as packet 1, and has a longitudinal axis 7 coincident with axis A of packet 1.

With reference to FIG. 2, packet 1 is formed from an elongated cardboard blank 8 having a longitudinal axis of symmetry B. Blank 8 comprises a central portion 9 and two lateral portions 10 substantially parallel to axis B. Portion 9 comprises, in succession, a front panel 11; a bottom panel 12; a rear panel 13; a top panel 14; a front panel 15 of lid 3; and a flap 16. Panels 11 to 15 and flap 16 are separated from each other by respective preformed bend lines 17–21 crosswise with respect to axis B; and rear panel 13 has a further bend line 22 crosswise with respect to axis B and which acts as a hinge between lid 3 and cup-shaped body 2 once blank 8 is folded to form packet 1.

Figure 3:
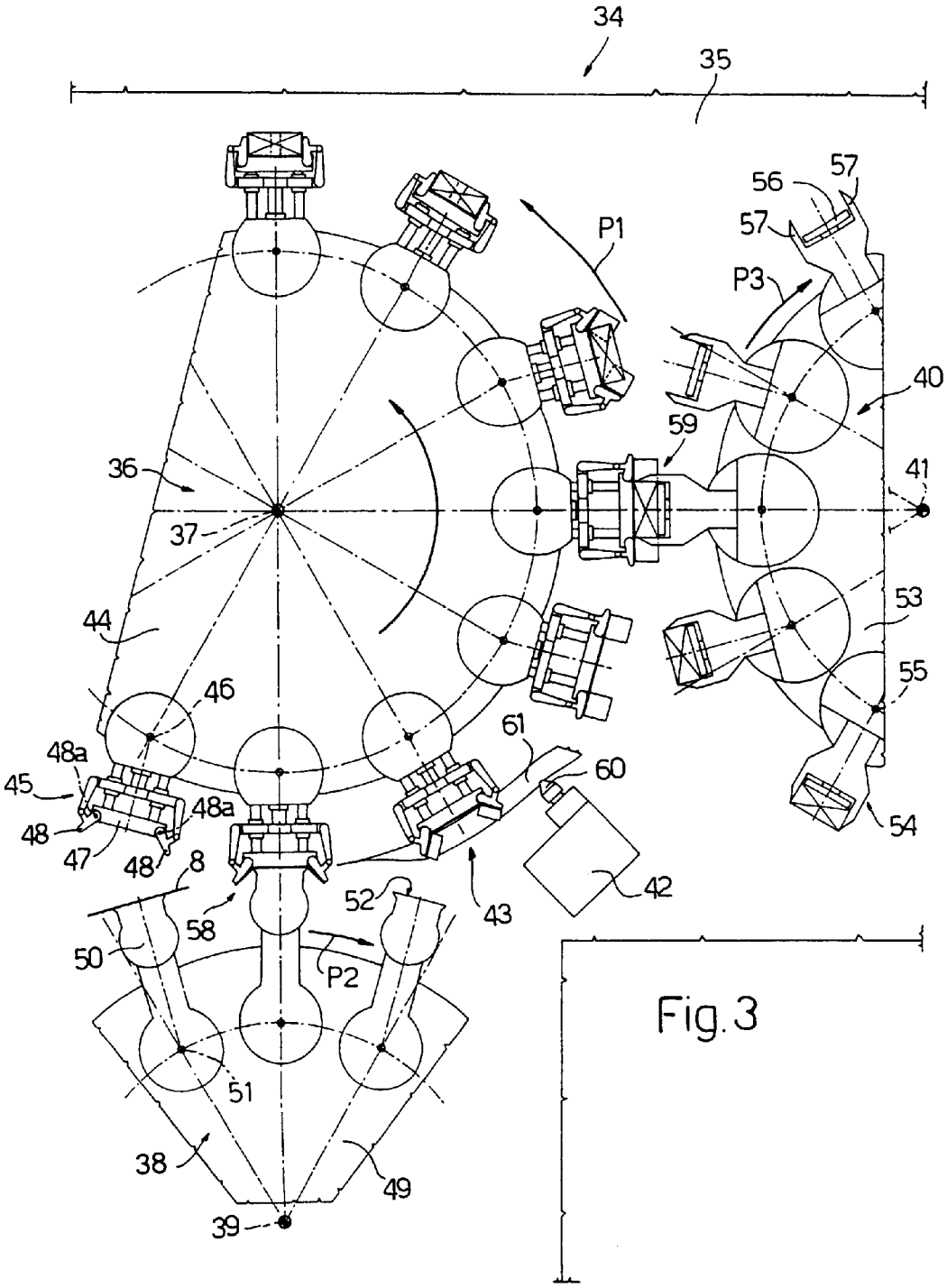
FIG. 3 shows a side view, with parts removed for clarity, of a machine for producing packets of cigarettes using the method according to the present invention.

Each portion 10 comprises a tab 23 connected to panel 11 by a bend line 24 parallel to axis B; two tabs 25 and 26 connected to panel 13 by a bend line 27 parallel to axis B; and a tab 28 connected to panel 15 by a bend line 29 parallel to axis B. Each tab 25 is integral with a tab 30, which is located between tabs 23 and 25 and connected to tab 25 by a bend line 31 perpendicular to axis B. Each tab 26 is integral with a tab 32, which is located between tabs 26 and 28 and connected to tab 26 by a bend line 33 perpendicular to axis B. In actual use, to form packet 1 in FIG. 1, each panel 11–15, flap 16, and each tab 23, 25, 26, 28, 30 and 32 must be folded about adjacent bend lines 17–21, 24, 27, 29, 31 and 33, making a total of fifteen folds, which are made on an automatic machine 34 shown partly in FIG. 3. Machine 34 comprises a frame 35, which supports a packaging wheel 36 rotating about an axis 37; a wheel 38 for supplying blanks 8 to wheel 36 and rotating about an axis 39 parallel to axis 37; and a packaging wheel 40 rotating about an axis 41 parallel to axis 37, and which, after folding sheet 5 and positioning collar 6, feeds groups 4 to wheel 36. Machine 34 also comprises a spray gumming device 42, and two helical folding devices 43, only one of which is shown in FIG. 3. Wheel 36 comprises a disk 44; and a number of pockets 45 equally spaced about axis 37 and movable along an annular path P1 about axis 37. Each pocket 45 can be oriented, with respect to disk 44, about a respective axis 46 parallel to axis 37, and comprises a bottom wall 47, and two lateral walls 48 hinged to and movable with respect to bottom wall 47 about respective axes 48*a* parallel to axis 37. Pocket 45 is oriented and lateral walls 48 positioned, for example, by means of respective known cam and tappet mechanisms not shown.

Wheel 38 comprises a disk 49; and a number of gripping heads 50 equally spaced about axis 39 and movable along a respective annular path P2 extending about axis 39. Each gripping head 50 can be oriented, with respect to disk 49, about a respective axis 51 by means of a known mechanism not shown, e.g. a cam and tappet mechanism, and comprises a gripping face 52 on which a blank 8 is retained by suction.

Like wheels 36 and 38, wheel 40 comprises a disk 53; and a number of pockets 54 equally spaced about axis 41 and movable along a respective annular path P3 extending about axis 41. Each pocket 54 can be oriented, with respect to disk 53, about a respective axis 55 by means of a known mechanism not shown, e.g. a cam and tappet mechanism, and comprises a bottom wall 56, and two lateral walls 57 perpendicular to bottom wall 56.

Pockets 45 and 54 and heads 50 are sized to convey blanks 8 and groups 4 with respective axes B and 7 parallel to axes 37, 39 and 41 of respective wheels 36, 38 and 40. More specifically, face 52 of each head 50 is substantially the same size as central portion 9 of blank 8, and is substantially larger parallel to than crosswise to axis 39; each pocket 45 is so sized that bottom wall 47 acts as a support for central portion 9 of blank 8, and lateral walls 48 face tabs 25 and 26 of blank 8; and pocket 54 is so sized as to position group 4 with a major face of group 4 contacting bottom wall 56, and with the elongated lateral faces of group 4 contacting lateral walls 57.

Machine 34 comprises a transfer station 58 for transferring blanks 8 from wheel 38 to wheel 36; and a transfer station 59 for transferring groups 4 from wheel 40 to wheel 36. With reference to path P1, station 59 is located downstream from station 58, which is offset angularly by about 90° with respect to station 59. Gumming device 42 is located between stations 58 and 59, and comprises a number of nozzles 60 extending parallel to axis 37 and facing a portion of path P1 between stations 58 and 59.

Helical folding devices 43 are located immediately downstream from station 58, and (though cut off in FIG. 3 for the sake of clarity) extend parallel to path P1 to a point beyond station 59. Each helical folding device 43 comprises a strip 61, which is initially parallel to axis 37 and twists so as to be eventually perpendicular to axis 37 before reaching station 59. The two helical folding devices 43 are supported by frame 35, and are separated by a distance substantially equal to the length of walls 48 of pockets 45, so that, in actual use, walls 48 are fed between helical folding devices 43.

Figures 4A, 4B, 4C, 4D, 5A, 5B, 5C, 5D:
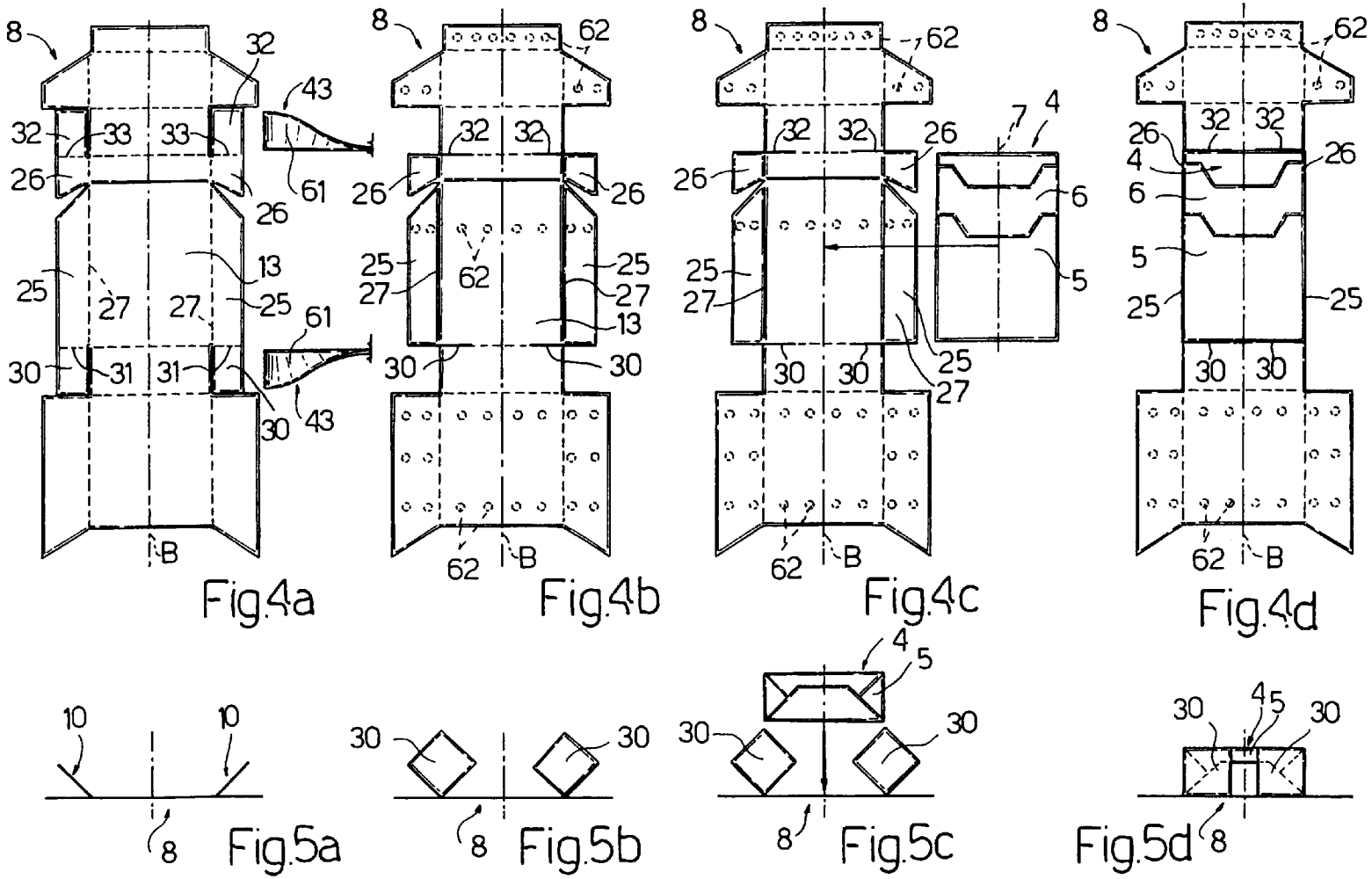
FIGS. 4*a*–4*d* show plan views of the FIG. 2 blank folded partly at successive steps in the method according to the present invention.
FIGS. 5*a*–5*d* show front views of the FIG. 2 blank folded partly at successive steps in the method according to the present invention.

In actual use, wheels 36, 38 and 40 of machine 34 rotate continuously and steadily about respective axes 37, 39 and 41; blanks 8 are supplied successively by wheel 38 and transferred from wheel 38 to wheel 36 at station 58; each blank 8 is conveyed on wheel 38 in the flat configuration shown in FIG. 2, and is retained by suction on respective head 50, the face 52 of which contacts portion 9 of blank 8; up- and downstream from transfer station 58, each head 50 and a respective pocket 45 are oriented about respective axes 51 and 46 so that face 52 is parallel to bottom wall 47; along a portion of path P1 at transfer station 58, walls 48 of pocket 45 are tilted with respect to wall 47; pocket 45 and head 50 are so oriented that blank 8 is transferred to pocket 45 in a movement, relative to pocket 45, substantially perpendicular to wall 47; and walls 48 are so positioned that tabs 25 and 26 are folded to form a given angle with respect to panel 13, as shown in FIGS. 4*a* and 5*a*. Though the given angle shown in FIG. 5*a* is about 45°, the method can also be implemented with other angles, in particular, angles of less than 90°. Tabs 25 and 26 are folded about bend lines 27; and tabs 30 and 32, being connected respectively to tabs 25 and 26, also form said given angle with respect to panels 12 and 14.

At the next conveying stage, pocket 45 keeps blank 8 in the above given position by means of suction by wall 47, and feeds blank 8 into engagement with helical folding devices 43, which are positioned between panel 12 and tabs 30 and between panel 14 and tabs 32 respectively. As they slide along helical folding devices 43, tabs 30 and 32 are folded substantially squarely, with respect to tabs 25 and 26, about respective bend lines 31 and 33, as shown in FIGS. 4*b* and 5*b*. At this stage, blank 8 travels past gumming device 42, which provides for applying spots 62 of gum onto blank 8. With reference to FIGS. 4*c* and 5*c*, group 4 is loaded onto panel 13 of the blank, and is transferred by so orienting pockets 45 and 54 at station 59 as to keep walls 47 and 56 of two respective pockets 45 and 54 facing and parallel to each other; in which condition, group 4 is loaded onto panel 13 and retained on panel 13 by known elements (not shown) of pocket 45. Walls 48 are then closed to bring tabs 25 and 26 into contact with group 4, while maintaining tabs 30 and 32 perpendicular to tabs 25 and 26, as shown in FIGS. 4*d* and 5*d*, by means of helical folding devices 43.

In a variation shown in FIGS. 6 and 7, once tabs 30 and 32 are folded with respect to tabs 25 and 26, walls 48 of pocket 45 are rotated, with respect to wall 47, into a position substantially coplanar with wall 47, so that tabs 25 and 26 spring back into a position coplanar with panel 13, and tabs 30 and 32 are positioned perpendicular to panel 13. In other words, blank 8 assumes the FIGS. 6 and 7 configuration to receive group 4. If folded at an angle close to a right-angle, tabs 25 and 26 will spring back by only a small amount into an intermediate position between a position aligned with rear panel 13 and a position tilted slightly with respect to rear panel 13.

In other words, movable walls 48 of pocket 45 are used to fold tabs 25 and 26 onto group 4 and, at the same time, to partly fold tabs 25, 26, 30 and 32 with respect to rear panel 13, so that tabs 30 and 32 are so positioned as to be intercepted by helical folding devices 43.

What is claimed is:

1. A method of producing hinged-lid packets of cigarettes on a continuous automatic machine, whereby a blank (8) is closed about a group (4) of cigarettes, the blank (8) comprising a longitudinal axis (B), a rear panel (13), first tabs (25, 26) connected to said rear panel (13), and second and third tabs (30, 32) connected to said first tabs (25, 26); the method comprising the step of feeding said blank (8) continuously along a given path (P1) with the axis (B) of the blank crosswise to said path (P1); folding said first, second and third tabs (25, 26, 30, 32) with respect to said rear panel (13) so that said second and third tabs (30, 32) are so positioned as to be intercepted by fixed folding devices (43) located along said path (P1); and folding inwards the second and third tabs (30, 32) with respect to the first tabs (25, 26) by the action of the fixed folding devices (43).

2. A method as claimed in claim 1, wherein said first tabs (25, 26) are hinged to said rear panel (13) about first bend lines (27) parallel to said longitudinal axis (B); and in that said second and third tabs (30, 32) are hinged to said first tabs (25, 26) about respective second and third bend lines (31, 33) perpendicular to said longitudinal axis (B).

3. A method as claimed in claim 1, wherein said second and third tabs (30, 32) are folded by the fixed folding devices (43) at a right-angle with respect to the first tabs (25, 26).

4. A method as claimed in claim 1, wherein said first tabs (25, 26) are folded to form a given angle of less than 90° with respect to the rear panel (13), and to set said second and third tabs (30, 32) to said intercept position.

5. A method as claimed in claim 1, wherein a group (4) of cigarettes is loaded onto the rear panel (13) of said blank (8) after said second and third tabs (30, 32) have been folded by the fixed folding devices (43) at a right-angle with respect to the first tabs (25, 26).

6. A method as claimed in claim 5, wherein said first tabs (25, 26) are positioned substantially coplanar with said rear panel (13) before said group (4) is loaded onto said rear panel (13).

7. A method as claimed in claim 5, wherein the folding of said first, second and third tabs (25, 26, 30, 32) with respect to said rear panel (13) comprises inserting said blank (8) inside a pocket (45) having lateral movable walls (48) opposing said first tabs (25, 26); and pushing said rear panel (13) onto a bottom wall (47) of said pocket (45).

8. A method as claimed in claim 7, wherein said second and third tabs (30, 32) project on opposite sides from the lateral walls (48).

9. A method as claimed in claim 8, wherein said fixed folding devices (43) are two helical folding devices (43) located along said given path (P1), so that the movable walls (48) of each pocket (45) are inserted between said helical folding devices (43).

10. A method as claimed in claim 5, wherein said first tabs (25, 26) are folded onto said group (4) of cigarettes to form a right-angle with said rear panel (13).

11. A machine for producing hinged-lid packets of cigarettes, wherein a blank (8), comprising a longitudinal axis (B), a rear panel (13), first tabs (25, 26) connected to said rear panel (13), and second and third tabs (30, 32) connected to said first tabs (25, 26), is closed about a group of cigarettes; said machine comprising a continuous first conveyor (36) having pockets (45) and for feeding said blank (8) along a given path (P1) with the axis (B) of the blank crosswise to said path (P1); and fixed folding means (43) located along said path (P1) for folding inwards the second and third tabs (30, 32) with respect to the first tabs (25, 26); each pocket (45) having walls (48) for folding said first, second and third tabs (25, 26, 30, 32) with respect to said rearpanel (13) so that said second and third tabs (30, 32) are so positioned as to be intercepted by said fixed folding devices (43) and to be folded inwards with respect to the first tabs (25, 26).

12. A machine as claimed in claim 11, wherein said first tabs (25, 26) are hinged to said rear panel (13) about first bend lines (27) parallel to said longitudinal axis (B); and in that said second and third tabs (30, 32) are hinged to said first tabs (25, 26) about respective second and third bend lines (31, 33) perpendicular to said longitudinal axis (B); said walls (48) rotating about respective axes (48*a*) crosswise to said path (P1).

13. A machine as claimed in claim 12, wherein said fixed folding devices (43) extend parallel to said path (P1) to fold said second and third tabs (30, 32) at a right-angle with respect to the first tabs (25, 26).

14. A machine as claimed in claim 13, and comprising a third conveyor (40) for transferring a group (4) of cigarettes onto the rear panel (13) of said blank (8) after said second and third tabs (30, 32) have been folded at a right-angle with respect to the first tabs (25, 26).

15. A machine as claimed in claim 12, wherein each pocket (45) comprises a bottom wall (47) for retaining the rear panel (13); said walls (48) rotating about said axes (48*a*) with respect to said bottom wall to fold said first tabs (25, 26) at a given angle of less than 90° with respect to the rear panel (13), and to set said second and third tabs (30, 32) to said intercept position.

16. A machine as claimed in claim 15, comprising a second conveyor (38) for feeding said blanks (8) to said first conveyor (36); said second conveyor (38) comprising a number of heads (50) for conveying respective flat blanks (8); and each head (50) being inserted inside a respective pocket (45) to transfer the blank (8) and simultaneously fold said first tabs (25, 26) at said given angle with respect to the rear panel (13).

17. A machine as claimed in claim 15, wherein said walls (48) are movable about respective axes (48*a*) to modify the angle formed between said first tabs (25, 26) and the rear panel (13), before said group (4) of cigarettes is loaded onto said rear panel (13).

18. A machine as claimed in claim 12, wherein said fixed folding devices (43) are two helical folding devices (43) located a given distance apart in a direction crosswise to the given path (P1), so that the walls (48) of each pocket (45) travel between said helical folding devices (43).

19. A method of producing hinged-lid packets of cigarettes on a continuous automatic machine, whereby a blank (8) is closed about a group (4) of cigarettes, the blank (8) comprising a longitudinal axis (B), a rear panel (13), first lateral tabs (25, 26) connected at opposite sides to said rear panel (13), and second and third tabs (30, 32) connected at opposite sides to each said first lateral tab (25, 26); the method comprising the step of feeding said blank (8) continuously along a given path (P1); folding said first, second and third tabs (25, 26, 30, 32) with respect to said rear panel (13) so that said second and third tabs (30, 32) are so positioned as to be intercepted by fixed folding devices (43) located along said path (P1); square folding inwards the second and third tabs (30, 32) with respect to the first tabs (25, 26) by the action of the fixed folding devices (43); letting the first tabs (25, 26) to spring back into a position coplanar with the rear panel (13); loading a group (4) of cigarettes onto the rear panel (13); and square folding the first tabs (25, 26) with respect to said rear panel (13) and into contact with said group (4) of cigarettes while maintaining said second and third tabs (30, 32) substantially perpendicular to the relevant first lateral tabs (25, 26).

20. A method as claimed in claim 19, wherein said blank (8) is conveyed continuously by a first conveyor (36) defining the first path (P1) along which are located a first transfer station (58) for transferring blanks (8) to said first conveyor (36), and a second transfer station (59) for transferring groups (4) of cigarettes to said first conveyor (36); said second and third tabs (30, 32) are folded along a portion of said path (P1) extending between the first and the second transfer station (58, 59).

21. A method as claimed in claim 20, wherein each blank (8) is gummed by a spray gumming device (42) located between said first and said second transfer station (58, 59).

22. A method as claimed claim 20, wherein each blank (8) is fed in a plain condition to said first conveyor (36).

23. A method of producing hinged-lid packets of cigarettes on a continuous automatic machine, whereby a blank (8) is closed about a group (4) of cigarettes, the blank (8) comprising a longitudinal axis (B), a rear panel (13), first tabs (25, 26) connected to said rear panel (13), and second and third tabs (30, 32) connected to said first tabs (25, 26); the method comprising the step of feeding said blank (8) continuously along a given path (P1) with the axis (B) of the blank crosswise to said path (P1); folding said first, second and third tabs (25, 26, 30, 32) with respect to said rear panel (13) so that said second and third tabs (30, 32) are so positioned as to be intercepted by fixed folding devices (43) located along said path (P1); and folding the second and third tabs (30, 32) with respect to the first tabs (25, 26) by the action of the fixed folding devices (43); a group (4) of cigarettes being loaded onto the rear panel (13) of said blank (8) after said second and third tabs (30, 32) have been folded by the fixed folding devices (43) at a right-angle with respect to the first tabs (25, 26); the folding of said first, second and third tabs (25, 26, 30, 32) with respect to said rear panel (13) comprises inserting said blank (8) inside a pocket (45) having lateral movable walls (48) opposing said first tabs (25, 26), and pushing said rear panel (13) onto a bottom wall (47) of said pocket (45); said second and third tabs (30, 32) projecting on opposite sides from the lateral walls (48); and said fixed folding devices (43) being two helical folding devices (43) located along said given path (P1), so that the movable walls (48) of each pocket (45) are inserted between said helical folding devices (43).

24. A machine for producing hinged-lid packets of cigarettes, wherein a blank (8), comprising a longitudinal axis (B), a rear panel (13), first tabs (25, 26) connected to said rear panel (13), and second and third tabs (30, 32) connected to said first tabs (25, 26), is closed about a group of cigarettes; said machine comprising a continuous first conveyor (36) having pockets (45) and for feeding said blank (8) along a given path (P1) with the axis (B) of the blank crosswise to said path (P1); and fixed folding means (43) located along said path (P1) for folding the second and third tabs (30, 32) with respect to the first tabs (25, 26); each pocket (45) having walls (48) for folding said first, second and third tabs (25, 26, 30, 32) with respect to said rear panel (13) so that said second and third tabs (30, 32) are so positioned as to be intercepted by said fixed folding devices (43); said first tabs (25, 26) being hinged to said rear panel (13) about first bend lines (27) parallel to said longitudinal axis (B); said second and third tabs (30, 32) being hinged to said first tabs (25, 26) about respective second and third bend lines (31, 33) perpendicular to said longitudinal axis (B); said walls (48) rotating about respective axes (48*a*) crosswise to said path (P1).

* * * * *

UNITED STATES PATENT AND TRADEMARK OFFICE

CERTIFICATE OF CORRECTION

PATENT NO. : 6,625,957 B2
DATED : September 30, 2003
INVENTOR(S) : Spatafora

It is certified that error appears in the above-identified patent and that said Letters Patent is hereby corrected as shown below:

Title page,
Item [73], Assignee, "Societe'" should be -- Societa' --

Column 6,
Line 30, "comprising" should be -- and comprising --

Signed and Sealed this

Second Day of March, 2004

JON W. DUDAS
*Acting Director of the United States Patent and Trademark Office*